US010072475B2

(12) United States Patent
Liezenberg

(10) Patent No.: US 10,072,475 B2
(45) Date of Patent: Sep. 11, 2018

(54) INTEGRATED MANAGED PRESSURE DRILLING RISER JOINT

(71) Applicant: M-I L.L.C., Houston, TX (US)

(72) Inventor: Bastiaan Liezenberg, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 581 days.

(21) Appl. No.: 14/174,508

(22) Filed: Feb. 6, 2014

(65) Prior Publication Data

US 2014/0216751 A1 Aug. 7, 2014

Related U.S. Application Data

(60) Provisional application No. 61/761,345, filed on Feb. 6, 2013.

(51) Int. Cl.

| | |
|---|---|
| ***E21B 33/06*** | (2006.01) |
| ***E21B 17/01*** | (2006.01) |
| ***E21B 21/08*** | (2006.01) |
| ***E21B 33/08*** | (2006.01) |

(52) U.S. Cl.
CPC ..... *E21B 33/06* (2013.01); *E21B 17/01* (2013.01); *E21B 21/08* (2013.01); *E21B 33/085* (2013.01)

(58) Field of Classification Search
None
See application file for complete search history.

(56) References Cited

U.S. PATENT DOCUMENTS

| | | | | |
|---|---|---|---|---|
| 4,626,135 | A * | 12/1986 | Roche | E21B 21/001 166/84.4 |
| 5,676,209 | A | 10/1997 | Reynolds | |
| 6,470,975 | B1 * | 10/2002 | Bourgoyne | E21B 21/001 166/367 |
| 7,350,597 | B2 | 4/2008 | Reitsma et al. | |
| 7,699,109 | B2 * | 4/2010 | May | E21B 33/085 166/339 |
| 2012/0177313 | A1 | 7/2012 | Beauchamp et al. | |

* cited by examiner

*Primary Examiner* — Matthew R Buck
*Assistant Examiner* — Douglas S Wood
(74) *Attorney, Agent, or Firm* — Paula B. Whitten

(57) ABSTRACT

An apparatus comprises a telescoping marine riser action and one of a rotating control device and an annular blow out preventer. The telescoping marine riser section comprises an inner barrel and an outer barrel. The one of a rotating control device and an annular blow out preventer is disposed inside the outer barrel.

11 Claims, 2 Drawing Sheets

INTEGRATED MANAGED PRESSURE DRILLING RISER JOINT

CROSS-REFERENCE TO RELATED APPLICATION

This application claims benefit to U.S. Provisional Application No. 61/761,345 filed on Feb. 6, 2013, which is incorporated by reference.

STATEMENT REGARDING FEDERALLY SPONSORED RESEARCH OR DEVELOPMENT

Not applicable.

BACKGROUND

Managed pressure drilling (MPD) wellbores through subsurface formations includes the use of a device known as a rotating control head or rotating control device (RCD) at a selected position above the top of the wellbore. The RCD includes a bearing and seal assembly that enables rotation of a drill string, and longitudinal motion of a drill string as the wellbore is drilled, while maintaining a fluid-tight seal between the drill string and the wellbore so that drilling fluid discharged from the wellbore may be discharged in a controlled manner. By controlling discharge of the fluid from the wellbore, a selected fluid pressure may be maintained in the annular space between the drill string and an exterior of the wellbore. Control of the discharge may be performed manually or automatically. One automatic system for controlling fluid discharge from the wellbore is described in U.S. Pat. No. 7,350,597 issued to Reitsma et al. and incorporated herein by reference.

Drilling, production and completion of offshore wells from a floating platform, e.g., a vessel, tension leg platform, etc. is conducted through a riser assembly which extends from the platform to the wellhead on the sea floor. The riser assembly includes a series of pipe sections connected end to end. Marine drilling risers provide a conduit through which materials may flow between the platform and a wellbore. While the platform from which the wellbore activities are being conducted is maintained as nearly as possible in the fixed position above the wellhead, there is some variation in this relationship, such that there is relative lateral and vertical shifting between the two. Accordingly, the riser assembly accommodates this relative movement between the platform and the wellhead as well as forces acting on the riser assembly from waves, currents and the like.

Marine managed pressure drilling using a riser or drilling fluid returns thus uses an RCD at a selected position along the length of the riser. FIG. 1 shows a conventional marine drilling system having an outer barrel 16 of a telescoping riser section coupled to the top of a fixed length of riser (not shown) that extends to a subsea wellhead (not shown). The telescoping riser section is supported by a tension ring 20 coupled to the outer barrel 16. The tension ring 20 is a type of buoyancy component for supporting at least part of the weight of the riser in a body of water. The tension ring 20 includes cables (not shown) that extend to the floating drilling platform 11 in order to transfer some of the buoyancy thereof to the tension ring 20 to support at least part of the weight of the riser in the body of water. An inner barrel 14 slidably, sealingly engages the interior of the outer barrel 16. A flex joint 12 and a diverter 10 are disposed at the top of the inner barrel 14. Thus, the length of the riser is able to be changed in order to compensate for heave of the drilling platform 11. The riser is also able to be moved laterally to compensate for lateral motion of the drilling platform 11. The tension ring 20 is disposed at a selected distance below the top 18 of the outer barrel 16.

FIG. 2 shows a system known in the art for marine managed pressure drilling. The system in FIG. 2 includes first and second inner barrels 14A, 14B, respectively, that sealingly, slidably engage with each other, where the second inner barrel 14B engages the outer barrel 16. In the system of FIG. 2, the outer barrel includes a top joint 16A that performs the function of slidably, sealingly engaging the inner barrel 14. An RCD 22 and an annular blowout preventer (BOP) 24 are coupled to the lower end of the top joint 16A, for example, by flanged couplings. A flow spool 26 is disposed below the annular BOP 24 to provide a flow path for drilling fluid exiting the well where a flow path in the riser above the RCD 22 is sealed by the RCD 22 when a drill string (not shown) is inserted therein. The tension ring 20 is disposed at a convenient position below the flow spool 26. The remainder of the lower barrel 16 is disposed below the tension ring 20. The remaining components of the system in FIG. 2 are similar to those shown in FIG. 1.

FIG. 3 shows another marine MPD system. In the system of FIG. 3, the RCD 22, annular BOP 24 and flow spool 26 are coupled to the bottom of the outer barrel 16, thus below the tension ring 20, which is affixed to the outer barrel 16 as previously explained. The system in FIG. 3 further includes a termination joint 28 disposed below the flow spool 26.

The marine MPD systems shown in FIG. 2 and FIG. 3 use extensive assembly and disassembly operations in order to service the RCD and the annular BOP. Further, testing the RCD and annular BOP may be performed after assembly of the riser system as shown in the foregoing figures.

DETAILED DESCRIPTION

Drilling, production and completion of offshore wells from a floating platform, e.g., a vessel, tension leg platform, etc. may be conducted through a riser assembly which extends from the platform to the wellhead on the sea floor. The riser assembly comprises a series of pipe sections connected end to end. Numerous methods to connect the individual pipe sections making up the marine riser assembly include threaded connections, weld-on connectors, etc. While the platform from which the wellbore activities are being conducted is maintained as nearly as possible in the fixed position above the wellhead, there is often some variation in this relationship, such that there is relative lateral and vertical shifting between the two. Accordingly, the riser assembly accommodates this relative movement between the platform and the wellhead as well as forces acting on the riser assembly from waves, currents and the like. Since the riser assembly is made up of various individual pipe sections, the connections between the pipe sections are designed to withstand the flexing and moving forces that occur in the riser assembly and while maintaining sealing integrity.

Figure 1:
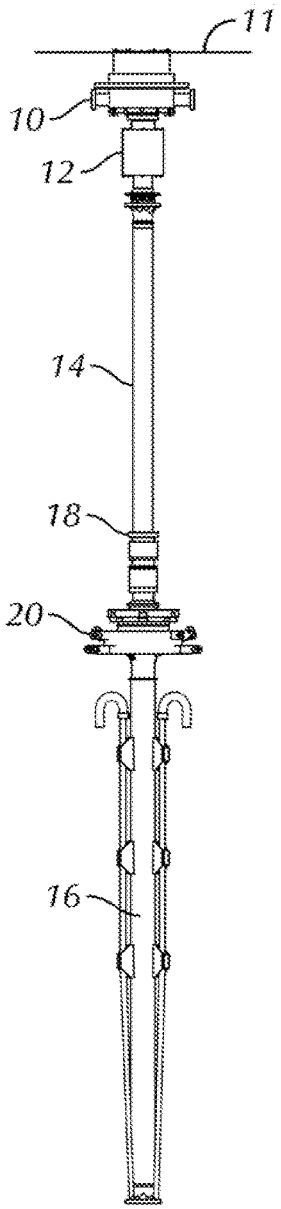
FIG. 1 (Prior Art)
FIG. 1 shows an example embodiment of a conventional marine drilling system using a riser.
Figure 2:
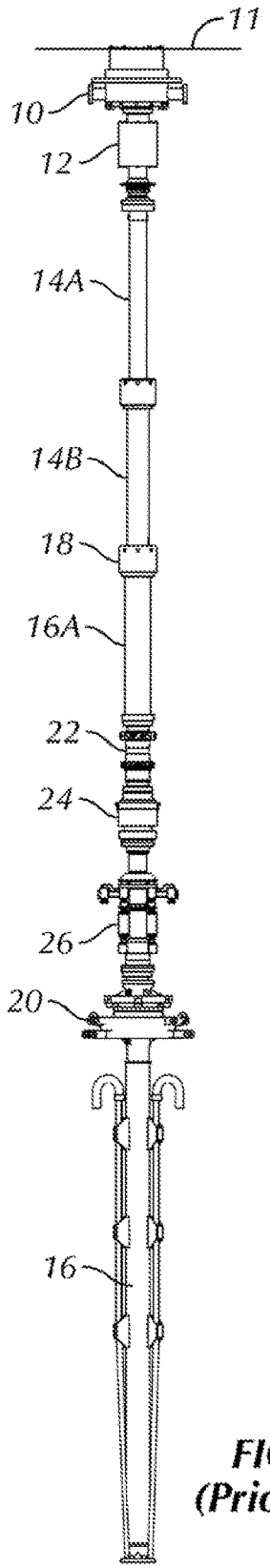
FIG. 2 (Prior Art)
FIG. 2 shows an example embodiment of a marine managed pressure drilling (MPD) system.
Figure 3:
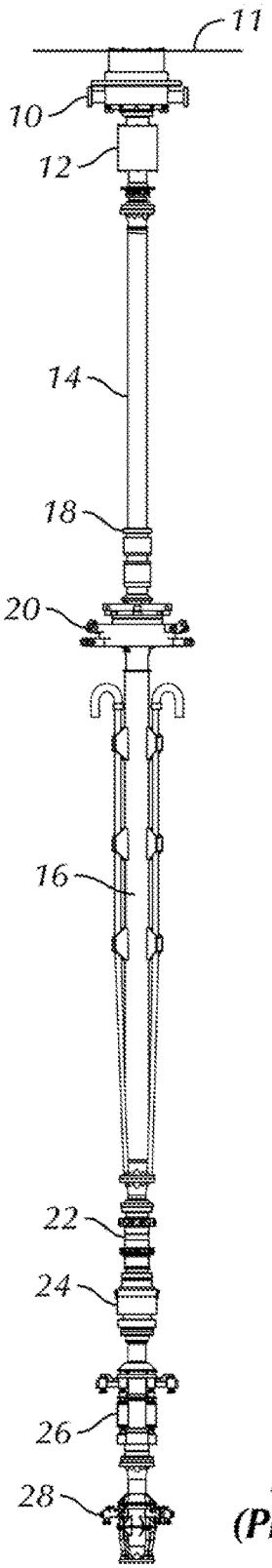
FIG. 3 (Prior Art)
FIG. 3 shows another example embodiment of a marine MPD system.
Figure 4:
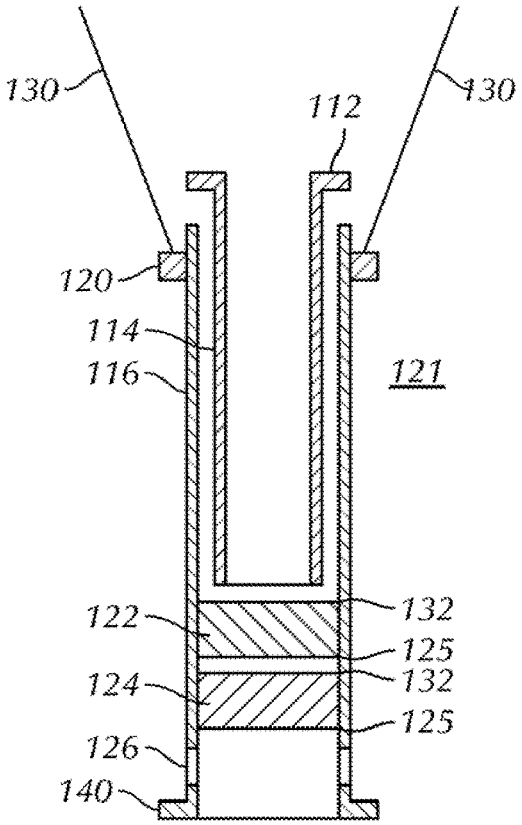
FIG. 4 shows an example embodiment of a marine MPD system according to the present disclosure.

An MPD riser joint according to the present disclosure is shown schematically in FIG. 4 as it might be used in a marine riser system. FIG. 4 does not show all components of the system, such as the drilling platform or the diverter for clarity of the illustration. An inner barrel 114 of a telescoping riser joint may have a flex joint 112 coupled to its upper end. The flex joint 112 may couple the inner barrel 114 to the platform, a diverter, or another tool. The inner barrel 114 sealingly, slidably engages an outer barrel 116 of the telescoping joint. In some embodiments, there may be more than one inner barrel. If the MPD riser joint includes more than one inner barrel, the inner barrels may be coupled to each other to extend the marine riser by any known techniques.

A tension ring 120 having tensioning cables or pistons 130 attached thereto may be affixed at a selected longitudinal position along the outer barrel 116. In some embodiments, the tension ring 120 may be disposed around the outer barrel 116 proximate an upper end of the outer barrel 116. In other embodiments, the tension ring 120 may be disposed around the outer barrel 116 at an axial location proximate a middle of the outer barrel 116. The tensioning cables or pistons 130 connect the tension ring 120, and therefore the outer barrel 116, to the platform (not shown). The tension ring 120 may also be referred to as a buoyancy component. The tension ring 120 provides the outer barrel 116 the ability to be disconnected from the inner barrel 114 without removing the outer barrel 116 from the marine riser system. In other words, the tension ring 120 and tensioning cables or pistons 130 support the outer barrel 116 when the inner barrel 114 and the outer barrel 116 are disconnected from one another.

A flow spool may be located adjacent to a lower end of the outer barrel 116. For example, a flow spool having a flow port 126 may be coupled to the lower end of the outer barrel 116. The flow spool may include a flange 140 or similar coupling on its lower end to couple to the remainder of the riser (not shown). In some embodiments, the flange 140 may be coupled to the lower end of the outer barrel 116 with the flange 140 including one or more flow ports 126. In other embodiments, one or more flow ports 126 may be integrated within or formed on the outer barrel 116 adjacent to the lower end thereof. For example, the flow spool may be disposed at the lower end of the outer barrel 116 (e.g., below the BOP 24) to provide a flow path for drilling fluid exiting the well.

In some embodiments, an annular BOP 124 may be placed in a lower end of the outer barrel 116 within the inner diameter of the outer barrel 116. For example, the annular BOP 124 may be placed inside the outer barrel 116 toward a lower end of the outer barrel 116. An outer surface of the BOP 124 is in sealing engagement with an inner diameter of the outer barrel 116. An outer diameter of the BOP 124 may be approximately equal to or slightly smaller than the inside diameter of the outer barrel 116. In some embodiments, a seal (not shown) may be disposed between the outer surface of the BOP 124 and the inner diameter of the outer barrel 116.

The outer barrel 116 inside diameter (ID) may be designed with a landing device located proximate a bottom end of the outer barrel 116 to position the annular BOP 124 within the outer barrel 116. Thus, the landing device may restrict axial movement of the annular BOP 124 in at least one direction, e.g., in a downward direction. In some embodiments, the landing device may be rotationally indexed. In other words, the landing device may rotationally align the annular BOP 124 or restrict rotational movement of the annular BOP 124 within the outer barrel 116 once engaged with the landing device. In some embodiments, the landing device of the outer barrel 116 may be configured to engage with a corresponding rotational indexing device (not shown) on the outer surf of the BOP 124 as the BOP 124 is positioned into the outer barrel 116. For example, the landing device may include one or more slots configured to receive one or more rotational indexing devices coupled to the BOP 124. The rotational indexing device may include, for example, a profile formed on the outer surface of the BOP 124, a pin, lug, or other similar device for engaging the one or more slots. The landing device may align the annular BOP 124 in a position to allow other components to interact with the annular BOP 124.

In one embodiment, the landing device may be a landing shoulder 125 located in the bottom section of the outer barrel 116. A bottom surface of the BOP 124 may engage with the landing, shoulder 125. In other embodiments, the landing shoulder 125 may be a separate component coupled to the inner diameter of the outer barrel 116 or through the outer barrel 116 that engages the bottom surface of the BOP 124 and restricts at least axial movement of the BOP 124 in the outer barrel 116. For example, a sleeve or landing ring may be coupled to the inside diameter of the outer barrel 116, the landing ring having an inside diameter smaller than the outside diameter of annular BOP 124. In other embodiments, one or more landing devices may protrude from the inside diameter of the outer barrel 116 or through the outer barrel 116 with which the bottom surface of annular BOP 124 may engage. The one or more landing devices may be spaced azimuthally around the circumference of the inside diameter of the outer barrel 116. In some embodiments, the landing shoulder 125 may be replaced by an array of bolts such as described in U.S. Patent Publication No. 2012/0085545 and incorporated herein by reference.

The BOP 124 may be held in place within the outer barrel 116 by a retaining device 132. In some embodiments, the retaining device 32 may be selected from hydraulically operated pistons, motor driven set screws, mechanical fasteners or other devices, such as a mechanical lock ring applied above the BOP 124. In some embodiments, the BOP 124 may be held in place due to the placement of the RCD 122. The retaining device 133 may be operable from a drilling platform for engaging or releasing the annular BOP 124. In some embodiments, the retaining device 132 may be disposed between the outer barrel 116 and the BOP 124. In other embodiments, the retaining device 132 may be disposed above the BOP 124. In some embodiments, the retaining device 132 may be part of the outer barrel 116 and may be locked in place after the BOP 124 is installed in the outer barrel 115. In yet other embodiments, the retaining device 132 may be part of the BOP 124 and may be engaged by a tool, fluid or pressure.

In some embodiments, an RCD 122 may also be placed in the outer barrel 116 within the inner diameter of the outer barrel 116. The RCD 122 may be placed inside the outer barrel 116 toward a lower end of the outer barrel 116. The RCD 122 may be positioned within the outer barrel 116 axially above the annular BOP 124. A bottom surface of the RCD 122 may be in contact with a top surface of the BOP 124. In some embodiments, the RCD 122 and BOP 124 may be a single component or may be two separate components. The RCD 122 and BOP 124 may be coupled together in some embodiments. An outer surface of the RCD 122 is in sealing engagement with an inside diameter of the outer barrel 116. An outer diameter of the RCD 122 may be approximately equal to or slightly smaller than the inside diameter of the outer barrel 116. In some embodiments, a seal (not shown) may be placed between the outer surface of the RCD 122 and the inner diameter of the outer barrel 116. One example of an RCD that may be used in some examples is described in U.S. Patent Application Publication No. 2012/0177313 filed by Beauchamp et. al. and incorporated herein by reference.

The outer barrel 116 ID may be designed with an additional landing device located in a bottom section of the outer barrel 116 to position the RCD 122 within the outer barrel 116. Thus, the landing device may restrict axial movement of the RCD 122 in at least one direction, e.g. in a downward direction. In some embodiments, the landing, device may be rotationally indexed. In other words, the landing device may rotationally align the RCD 122 or restrict rotational movement of the RCD 122 within the outer barrel 116 once engaged with the landing device. In some embodiments, the landing device of the outer barrel 116 may be configured to engage with a corresponding rotational indexing device (not shown) on the outer surface of the RCD 122 as the RCD 122 is positioned into the outer barrel 116. For example, landing device may include one or more slots configured to receive one or more rotational indexing devices coupled to the RCD 122. The rotational indexing device may include, for example, a profile formed on the outer surface of the RCD 122, a pin, lug, or other similar device for engaging the one or more slots. The landing device may align the RCD 122 in a position to allow other components to interact with the RCD 122.

In one embodiment, the landing device may be a landing shoulder 125 located in the bottom section of the outer barrel 116. A bottom surface of the RCD 122 may engage with the landing shoulder 125. In other embodiments, the landing shoulder 125 may be a separate component coupled to the inner diameter of the outer barrel 116 or through the outer barrel 116 that engages the bottom surface of the RCD 122 and restricts at least axial movement of the RCD 122 in the outer barrel 116. For example, a sleeve or landing ring may be coupled to the ID of the outer barrel 116, the landing ring having an inside diameter smaller than the outside diameter of RCD 122. In other embodiments, one or more landing devices may protrude from the ID of the outer barrel 116 or through the outer barrel 116 with which the bottom surface of RCD 122 may engage. The one or more landing devices may be spaced azimuthally around the circumference of the ID of the outer barrel 116. In some embodiments, the landing shoulder 125 may be replaced by an array of bolts such as described in U.S. Patent Publication No. 2012/0085545 and incorporated herein by reference.

The RCD 122 may be held in place within the outer barrel 16 by a retaining device 132. In some embodiments, the retaining device 132 may be selected from hydraulically operated pistons, motor driven set screws, mechanical fasteners or other devices, such as a mechanical lock ring applied above the RCD 122. The retaining device 132 may be operable from the drilling platform for engaging or releasing the RCD 122. In some embodiments, the retaining device 132 may be a locking device which is operable to controllably retain one of the RCD 22 and the annular BOP 124 in the outer barrel 116. In some embodiments, the retaining device 132 may be disposed between the outer barrel 116 and the RCD 122. In some embodiments, the retaining device 132 may be part of the outer barrel 116 and may be locked in place after the RCD 122 is installed in the outer barrel 116. In other embodiments, the retaining device 132 may be part of the RCD 122 and may be engaged by a tool, fluid or pressure.

In conventional riser joints, the RCD 22 and BOP 24 components may be coupled to the outer barrel 16 and therefore, the outer barrel 16 and components are removed along with the inner barrel 14 from the riser joint to be serviced and/or repaired. An integrated riser joint, e.g., as described herein, where the RCD 122 and/or BOP 124 are disposed inside the outer barrel 116, may allow the riser joint to maintain its functionality and may allow access to the RCD 122 or BOP 124 by simply removing the inner barrel 114. In some embodiments, either the RCD 122 or the BOP 124 may be placed within the outer barrel 116 as described above.

In one embodiment, assembly of an integrated riser joint as described herein may include pre-assembly of the outer barrel 116 and at least one of the annular BOP 124 and the RCD 122 as a system prior to shipment to the drilling platform. The pre-assembled system may be tested for proper operation of the RCD 122 and annular BOP 124 prior to assembly of the outer tube 116 to the remainder of the integrated riser joint. By incorporating at least one the annular BOP 124 and the RCD 122 within the outer barrel 116, a larger inside diameter of the outer barrel may be provided. The larger inside diameter of the outer barrel 116 may enable using a larger inner diameter RCD 122, thus enabling using a larger diameter drill string or casing to be moved through the RCD 122. Larger diameters of the outer barrel 116 may enable the use of managed pressure drilling in shallower wellbore sections or even casing drilling with managed pressure.

During pre-assembly of the integrated riser joint, the BOP 124 may be placed within the outer barrel 116 and come to rest upon the landing shoulder 125. The RCD 122 will then be placed within the outer barrel 116 and come to rest upon the BOP 124. In some embodiments, the retaining device 132 may be part of the outer barrel 116 and may be locked in place after the RCD 122 is installed in the outer barrel 116. In one embodiment, after pre-assembly of the integrated riser joint described herein, the integrated riser joint assembly may then be installed on the telescoping marine riser by coupling the outer barrel 116 to the flow spool and the tension ring 120. The inner barrel 114 may then be coupled to the outer barrel 116 and the flex joint 112. The BOP 124 and RCD 122 may then be engaged to the outer barrel 116 via their respective retaining devices 132. In other embodiments, the retaining device 132 may be part of the RCD 122 and may be engaged by a tool, fluid or pressure.

If servicing or replacement of either the RCD 122 or the annular BOP 124, components above the outer barrel 116, for example, a diverter, flex joint 112 and/or inner barrel 114 may be removed to access the outer barrel 116 and the RCD 122 and or the BOP 124 therein. The outer barrel 116 remains attached to the tension ring 120, thereby keeping the remainder of the riser joint functional below the tension ring 120. The retaining device 122A may then be operated to release the RED 122 and/or annular BOP 124 from the outer barrel 116. Service tools may be threaded into the outer barrel 116 to service the RCD 122 and/or annular BOP 124. In other embodiments, the RCD 122 and/or annular BOP 124 may be removed and serviced outside the outer barrel 116. The RCD 122 and/or annular BOP 124 may be removed from the outer barrel 116 using any known form of running tool. After servicing or replacement of any part of the RCD 122 and/or annular BOP 124, the assembly may be reinserted into the outer barrel 116 and the retaining device 122A may be operated to retain the assembly in the outer tube 116.

In accordance with embodiments described herein, the RCD and/or annular BOP may be retrieved from an integrated managed pressure drilling riser joint for servicing without disassembling any portion of the riser system below the tension ring, or without disassembling individual riser system components disposed above the tension ring. The RCD and annular BOP may be pre-assembled as a system and tested prior to shipment to the drilling platform. In accordance with embodiments described herein, the annular BOP may be retrieved from an riser gas handling system for servicing, without disassembling any portion of the handling system below the tension ring, or without disassembling individual handling system components disposed above the tension ring.

Various combinations of the RCD 122 and annular BOP 124 may be utilized in the telescoping marine riser. For example, the telescoping marine riser may include, at the lower end of the outer barrel 116, the combination of the RCD 122, the annular BOP 124 and the flow port (or flow spool) arranged in a downward order. In other embodiments, the telescoping marine riser may include, at the lower end of the outer barrel 116, the combination of the RCD 122 and the flow port (or flow spool) arranged in a downward order. In yet other embodiments, the telescoping marine riser may include, at the lower end of the outer barrel 116, the combination of the annular BOP 124 and the flow port (or flow spool) arranged in a downward order.

For purposes of this disclosure, terms such as "above", "below", "upper" or "lower" should not he construed to merely indicate a location along a vertical axis. Rather, the terms should be construed to indicated a position along a longitudinal axis of the marine riser section. While the ordinary meaning of the aforementioned terms may be applicable in case that the marine riser section is vertically oriented, the terms should be construed more broadly and should be interpreted with reference to the longitudinal axis of the marine riser section. For example, the marine riser section may be deemed to have an upper end and a lower end and location A would be "above" location B if location A were closer to the upper end along the longitudinal axis of the marine riser section.

In one aspect, embodiments disclosed herein relate to an apparatus having a telescoping marine riser including an inner barrel and an outer barrel, and one of a rotating control device and an annular blow Out preventer disposed inside the outer barrel.

In another aspect, embodiments disclosed herein relate to a method, the method includes providing an annular blowout preventer retainably coupled in an outer barrel of a telescoping marine riser, coupling the outer barrel to a buoyancy component, coupling a lower end of an inner barrel of the telescoping marine riser to the outer barrel, and coupling an upper end of the inner barrel of the telescoping marine riser to a flex joint.

In another aspect, embodiments disclosed herein relate to a method, the method includes providing a drilling component. The drilling component includes an inner barrel and an outer barrel. A lower end of the inner barrel is coupled to the outer barrel. The outer barrel has at least one of a rotating control device and an annular blow out preventer coupled therein. The method also includes uncoupling the inner barrel from the outer barrel to thereby remove the inner barrel from the drilling component and servicing or retrieving at least one of the rotating control device and the annular blow out preventer through the outer barrel.

Although the preceding description has been described herein with reference to particular means, materials and embodiments, it is not intended to be limited to the particulars disclosed herein. Rather, it extends to all functionally equivalent structures, methods and uses, such as are within the scope of the appended claims.

What is claimed is:

1. A method comprising:

Providing an annular blowout preventer retainably coupled in an outer barrel of a telescoping marine riser;

Coupling the outer barrel to a buoyancy component;

Coupling a lower end of an inner barrel of the telescoping marine riser to the outer barrel;

Coupling an upper end of the inner barrel of the telescoping marine riser to a flex joint; and Uncoupling the inner barrel from the outer barrel to thereby remove the inner barrel from the telescoping mariner riser.

2. The method of claim 1, further comprising retainably coupling a rotating control device in the outer barrel.

3. The method of claim 1, further comprising coupling a rotating control device to the annular blowout preventer.

4. The method of claim 1, engaging a lower surface of the annular blowout preventer to a landing device coupled to the outer barrel.

5. The method of claim 1, actuating a locking device to couple the annular blowout preventer to the outer barrel.

6. The method of claim 2, actuating a locking device to couple the rotating control device to the outer barrel.

7. A method comprising:

Providing a drilling component in a marine riser, the drilling component comprising:

An inner barrel; and

An outer barrel, a lower end of the inner barrel coupled telescopically to the outer barrel, the outer barrel having at least one of a rotating control device and an annular blow out preventer coupled therein;

Uncoupling the inner barrel from the outer barrel to thereby remove the inner barrel from the drilling component;

Retrieving one or more components of at least one of the rotating control device and the annular blow out preventer through the outer barrel.

8. The method of claim 7, wherein the servicing or retrieving comprises running a service tool through the outer barrel.

9. The method of claim 7, wherein an upper end of the inner barrel is coupled to a flex joint.

10. The method of claim 7, further comprising inserting the at least one of the rotating control device and the annular blow out preventer through the outer barrel.

11. The method of claim 7, the drilling component further comprising a buoyancy component, wherein the retrieving the at least one of the rotating control device and the annular blow out preventer through the outer barrel is performed without disassembly of a riser system below the buoyancy component.

* * * * *